United States Patent [19]

Phifer et al.

[11] Patent Number: 4,624,793

[45] Date of Patent: Nov. 25, 1986

[54] FIBER FINISHES

[75] Inventors: John E. Phifer, Woodruff; Charles R. Tucker, Spartanburg; Roger H. Garst, Greer, all of S.C.

[73] Assignee: National Distillers and Chemical Corporation, New York, N.Y.

[21] Appl. No.: 622,360

[22] Filed: Jun. 20, 1984

[51] Int. Cl.[4] ..... D06M 13/32

[52] U.S. Cl. ..... 252/8.6; 8/115.6; 8/DIG. 9; 428/254

[58] Field of Search ..... 252/8.6, 8.8, 8.9; 8/115.6, DIG. 9

[56] References Cited

U.S. PATENT DOCUMENTS

| | | | |
|---|---|---|---|
| 3,639,235 | 2/1972 | Krag | 252/8.9 |
| 3,943,178 | 3/1976 | Stein et al. | 252/8.9 |
| 4,242,095 | 12/1980 | Carver | 252/8.9 |
| 4,291,093 | 9/1981 | Wishman et al. | 252/8.9 |
| 4,426,298 | 1/1984 | Shepley | 252/8.9 |

FOREIGN PATENT DOCUMENTS

| | | | |
|---|---|---|---|
| 0804964 | 11/1958 | United Kingdom | 252/8.9 |

*Primary Examiner*—Paul Lieberman
*Assistant Examiner*—John F. McNally
*Attorney, Agent, or Firm*—Kenneth D. Tremain; Gerald A. Baracka

[57] ABSTRACT

Improved lubricant compositions useful as finishes for polypropylene fibers, filaments and yarns and comprised of components which meet the requirements of 21 CFR 178.3400 as indirect food additives are provided. The finish compositions are comprised of specific ethoxylated secondary linear alcohols, specific ethoxylated linear or branched alcohol phosphate esters neutralized with potassium or sodium hydroxide and water. A hydroxylic coupling agent may also be present.

7 Claims, No Drawings

FIBER FINISHES

BACKGROUND OF THE INVENTION

1. Field of the Invention

The present invention relates to improved lubricant compositions for finishing fibers and filaments wherein the lubricants meet the requirements of the Food and Drug Administration (FDA) for use as indirect food additives.

2. Description of the Prior Art

The need to use processing aids in the manufacture of synthetic fibers and filaments is well known and numerous lubricating finishes have been developed for this purpose. Where the fibers and yarns are used for food packaging materials, the lubricants must meet the requirements of the appropriate Food and Drug regulations.

A finishing composition comprised entirely of ingredients approved for use as direct or indirect food additives and useful for multi-filamentary yarns to be used in food packaging is disclosed in U.S. Pat. No. 3,993,571. The finishing compositions of U.S. Pat. No. 3,993,571 are useful for the treatment of synthetic linear polymer yarns, including polyamides, polyesters and polyolefins and are comprised of 47–53 weight percent butyl stearate or coconut oil, 16–20 weight percent sorbitan monooleate and 30–34 weight percent ethoxylated sorbitan monooleate. Mixtures of glycerol monooleate and ethoxylated sorbitan monolaurate also meet the FDA requirements and have been used by the industry as lubricants for processing fibers to be used for food packaging materials.

While finishes of the above types typically provide acceptable levels of lubrication for polyester and polyamide fibers, they are generally not as effective as finishes formulated using lubricants which are not approved for use as direct or indirect food additives. Moreover, they do not provide acceptable performance characteristics which the more difficulty processable non-polar polypropylene fibers. It would be highly advantageous if a finish, comprised solely of lubricants which meet the FDA requirements for use as indirect food additives were available which provided superior performance characteristics, particularly for polypropylene fibers.

SUMMARY OF THE INVENTION

In accordance with the above objectives, this invention provides aqueous fiber finished compositions suitable for use with synthetic fibers and filaments used for food packaging materials. The fiber finishes contain an ethoxylated secondary linear alcohol and an ethoxylated linear or branched alcohol phosphate ester neutralized with potassium hydroxide or sodium hydroxide to form the corresponding salt. Both components meet the requirements of 21 CFR 178.3400 for use as indirect food additives.

More specifically, the ethoxylated secondary linear alcohol is an α-alkyl-Ω-hydroxypoly(oxyethyl-ene) produced by condensation of 1 mole of $C_{11-15}$ straight-chain randomly substituted secondary alcohols with an average of 7 to 20 moles of ethylene oxide, and the ethoxylated linear or branched alcohol phosphate ester is either an α-dodecyl-Ω-hydroxypoly(oxyethyl-ene) mixture of dihydrogen phosphate and monohydrogen phosphate esters that have an acid number (to pH 5.2) of 103–111 produced by the esterification of the condensation product of 1 mole of n-dodecyl alcohol with 4–4.5 moles of ethylene oxide, or an α-tridecyl-Ω-hydroxypoly(oxyethyl-ene) mixture of dihydrogen phosphate and monohydrogen phosphate esters that have an acid number (to pH 5.2) of 75 to 85 produced by the esterification of the condensation product of one mole of "oxo" process tridecyl alcohol with 5.5–6.5 moles of ethylene oxide. The aqueous fiber finish compositions typically are comprised of from about 30 to 90 weight percent ethoxylated secondary linear alcohol, 5 to 60 weight percent of the ethoxylated phosphate ester salt and 0.5 to 25 weight percent water. Optionally, up to about 20 weight percent of a hydroxylic coupling agent may also be present.

The finish compositions of this invention exhibit excellent stability and provide superior lubrication and static protection for fibers and filaments. The compositions are particularly useful with polypropylene fibers, however, they may also be advantageously employed with other synthetic fibers, such as polyesters and polyamides, and with blends of synthetic and natural fibers.

DETAILED DESCRIPTION

In accordance with the present invention, aqueous fiber finish compositions are provided. The fiber finishes contain an ethoxylated alcohol and ethoxylated phosphate ester salt in specific proportions. More specifically, the fiber finishes are comprised of an ethoxylated secondary linear alcohol, an ethoxylated linear or branched alcohol phosphate ester, neutralized with potassium hydroxide or sodium hydroxide, and water.

Ethoxylated alcohols employed are derived from linear secondary alcohols having from 11 to 15 carbon atoms. Ethoxylated alcohols of this type are well known non-ionic surfactants and, depending on the the degree of ethoxylation, have varying degrees of emulsifying, wetting, and dispersing ability. Specifically, the ethoxylated secondary linear alcohols utilized for the present formulations are an α-alkyl-Ω-hydroxypoly(oxyethyl-ene) produced by the condensation of 1 mole of $C_{11-15}$ straight-chain randomly substituted secondary alcohols with an average 7 to 20 moles of ethylene oxide. A series of ethoxylated secondary linear alcohols of the above types are manufactured and sold by the Union Carbide Corporation and designated Tergitol ®15-S non-ionic surfactants. Linear secondary alcohol ethoxylates having from 11 to 15 carbon atoms in the hydrophobe and condensed with 7 to 12 moles ethylene oxide are especially advantageous. In a particularly preferred embodiment of this invention the secondary linear alcohol has, on an average, 7 to 9 moles of ethylene oxide condensed therewith.

Present with the ethoxylated linear secondary alcohol is an ethoxylated linear or branched alcohol phosphate ester which is neutralized to the corresponding salt with potassium hydroxide or sodium hydroxide. Specific ethoxylated alcohol phosphate esters employed are either the α-dodecyl-Ω-hydroxypoly)oxyethyl-ene) mixture of dihydrogen phosphate and monohydrogen phosphate esters that have an acid number (to pH 5.2) of 103–111 and that are produced by the esterification of the condensation product of 1 mole of n-dodecyl alcohol with 4–4.5 moles of ethylene oxide or α-tridecyl-Ω-hydroxypoly(oxyethyl-ene) mixture of dihydrogen phosphate and monohydrogen phosphate esters that have an acid number (to pH 5.2) of 75–85 and that are produced by the esterification of the condensation product of one mole of "oxo" process tridecyl alcohol with 5.5–6.5 moles of ethylene oxide. The ethoxylated alcohol phosphate ester products are known non-ionic surfactants and are available from commercial suppliers and are neutralized with an essentially stoichiometric amount of potassium hydroxide or sodium hydroxide to produce the potassium or sodium salt.

Both the ethoxylated linear secondary alcohol and the ethoxylated linear or branched alcohol phosphate ester meet the requirements of 21 CFR 178.3400 and may be safely used as emulsifiers and/or surface-active agents in the manufacture of articles or components of articles intended for use in producing, manufacturing, packing, processing, preparing, treating, packaging, transporting, or holding food, subject to the provisions set forth therein. Since both of the components are approved for use as indirect food additives, the resulting aqueous finishes can be utilized for processing filaments, fibers and yarns for the manufacture of materials intended for food contact, e.g. fabric used to wrap meat, dairy products, etc. In view of the superior processing characteristics and favorable economics of these finishes, the products may also be advantageously employed with fibers used for baby diapers, feminine hygiene products and the like.

Whereas the products of this invention may be used for the processing of nylon and polyester, they are particularly advantageous for processing polypropylene filaments, fibers and yarns. It is well known that polypropylene fibers differ from other synthetics (such as nylon or polyester) in that the polypropylene is almost completely non-polar. This results in poor wettability and severe static problems during handling and processing. Most finishes which are suitable for processing nylon and polyester are, therefore, unacceptable for polypropylene. There is a need by the industry for compositions which have acceptable processing characteristics with polypropylene filaments, fibers and yarns. The aqueous finishes of this invention, comprised of an ethoxylated secondary linear alcohol and ethoxylated linear or branched alcohol phosphate ester salt, meet all the processing requirements of the fine denier polypropylene staple fiber. Additionally, these finishes may be utilized with blends of polypropylene and other synthetic fibers.

The ethoxylated secondary linear alcohols and ethoxylated linear or branched alcohol phosphate ester salts are readily compatible and can be combined with water in virtually all proportions. The relative proportions of ethoxylated alcohol, ethoxylated phosphate ester salt and water will vary depending on the specific components employed and the particular properties required of the fiber finish. However, the aqueous fiber finish compositions (also referred to as "concentrates") generally contain from about 30 to 90 weight percent ethoxylated secondary linear alcohol, 5 to 60 percent ethoxylated linear or branched alcohol phosphate ester salt, and 0.5 to 25 weight percent water. These concentrates are subsequently further diluted with water or water/alcohol mixtures for application to the fiber during processing.

Where the fiber finish composition is to be stored prior to use it is advantageous to include a small amount, generally up to about 20 weight percent, of a hydroxylic coupling agent in the formulation. The coupling agent prevents gellation and/or the development of haze and makes it possible to obtain clear, homogeneous solutions which remain stable for prolonged periods and show no evidence of phase separation. Hydroxylic coupling agents which can be employed for this purpose include ethyl alcohol, propylene glycol, glycerine and sorbitol. Propylene glycol is an especially useful coupling agent in the above formulation. Especially useful compositions for finishing polypropylene fibers contain from about 35 to 70 weight percent ethoxylated secondary linear alcohol, 5 to 35 weight percent ethoxylated linear or branched alcohol phosphate ester salt, 1 to 20 weight percent water and 5 to 15 weight percent hydroxylic coupling agent.

The aqueous fiber finish compositions are easily prepared at ambient conditions with little or no agitation. They are essentially clear liquids (light yellow to amber) having a kinematic viscosity (25° C.) from about 100 to 200 centistokes. The pH of the fiber finishes is typically from about 5 to 7.

The following fiber finish compositions are provided to more fully illustrate the invention and the manner by which it can be practiced. All of these fiber finishes were obtained by dissolving the ethoxylated secondary linear alcohol; the ethoxylated alcohol phosphate ester salt; and, when present, hydroxylic coupling agent in water in the indicated proportions. All percentages are on a weight basis.

For the purpose of simplification, the following abbreviated terminology is employed in the examples:

| | |
|---|---|
| POE (7) $C_{11-15}$ alcohol = | α-alkyl-Ω-hydroxypoly (oxyethylene) produced by the condensation of 1 mole of $C_{11-15}$ straight-chain randomly substituted secondary alcohols with an average of 7 moles of ethylene oxide. |
| POE (9) $C_{11-15}$ alcohol = | α-alkyl-Ω-hydroxypoly (oxyethylene) produced by the condensation of 1 mole of $C_{11-15}$ straight-chain randomly substituted secondary alcohols with an average of 9 moles of ethylene oxide. |
| POE (12) $C_{11-15}$ alcohol = | α-alkyl-Ω-hydroxypoly (oxyethylene) produced by the condensation of 1 mole of $C_{11-15}$ straight-chain randomly substituted secondary alcohols with an average of 12 moles of ethylene oxide. |
| POE (4) DDA phosphate, $K^+$ = | α-dodecyl-Ω-hydroxypoly (oxyethylene) mixture of dihydrogen phosphate and monohydrogen phosphate esters that have an acid number (to pH 5.2) of 103–111 produced by the esteri- |

-continued

| | |
|---|---|
| POE (6) TDA phosphate, $K^+$ = | fication of the condensation product of 1 mole of n-dodecyl alcohol with 4 moles of ethylene oxide and neutralized fwith essentially a stoichiometric amount of potassium hydroxide. α-tridecyl-Ω-hydroxypoly (oxyethylene) mixture of dihydrogen phosphate and monohydrogen phosphate esters that have an acid number (to pH 5.2) of 75–85 produced by the esterification of the condensation product of 1 mole of "oxo" process tridecyl alcohol with 6 moles of ethylene oxide and neutralized with essentially a stoichiometric amount of potassium hydroxide. |

FIBER FINISH I
47.6% POE (7) $C_{11-15}$ alcohol
47.6% POE (6) TDA phosphate, $K^+$
4.8% water FIBER FINISH II
47.6% POE (9) $C_{11-15}$ alcohol
47.6% POE (6) TDA phosphate, $K^+$
4.8% water FIBER FINISH III
47.6% POE (12) $C_{11-15}$ alcohol
47.6% POE (6) TDA phosphate, $K^+$
4.8% water FIBER FINISH IV
48.25% POE (7) $C_{11-15}$ alcohol
48.25% POE (4) DDA phosphate, $K^+$
3.5% water FIBER FINISH V
48.25% POE (9) $C_{11-15}$ alcohol
48.25% POE (4) DDA phosphate, $K^+$
3.5% water FIBER FINISH VI
48.25% POE (12) $C_{11-15}$ alcohol
48.25% POE (4) DDA phosphate, $K^+$
3.5% water FIBER FINISH VII
35% POE (7) $C_{11-15}$ alcohol
32.5% POE (4) DDA phosphate, $K^+$
10.0% propylene glycol
22.5% water FIBER FINISH VIII
42.5% POE (7) $C_{11-15}$ alcohol
42.5% POE (4) DDA phosphate, $K^+$
10% propylene glycol
15% water FIBER FINISH IX
57.7% POE (7) $C_{11-15}$ alcohol
38.4% POE (6) TDA phosphate, $K^+$
3.8% water FIBER FINISH X
52.66% POE (7) $C_{11-15}$ alcohol
43.08% POE (6) TDA phosphate, $K^+$
4.26% water FIBER FINISH XI
47.64% POE (7) $C_{11-15}$ alcohol
47.64% POE (6) TDA phosphate, $K^+$
4.72% water FIBER FINISH XII
42.68% POE (7) $C_{11-15}$ alcohol
52.16% POE (6) TDA phospate, $K^+$
5.16% water FIBER FINISH XIII
89.1% POE (7) $C_{11-15}$ alcohol
9.9% POE (6) TDA phosphate, $K^+$
1.0% water FIBER FINISH XIV
88.3% POE (7) $C_{11-15}$ alcohol
9.8% POE (4) DDA phosphate, $K^+$
1.9% water -continued FIBER FINISH XV
77.1% POE (7) $C_{11-15}$ alcohol
19.3% POE (4) DDA phosphate, $K^+$
3.6% water To demonstrate the utility of the above-prepared products as lubricants for polypropylene, the finishes were applied to prescoured polypropylene yarn (210 denier/70 filament) at 1.00 percent o.w.f. Application of the fiber finish was made using an Atlab Finish Applicator. After application of the finish, the polypropylene yarns were brought to equilibrium moisture content by conditioning for a minimum of twenty-four hours at 70±3° F. and 40±2% relative humidity.

The treated yarns were then evaluated using standard test procedures. Data was obtained using a Rothschild F-Meter. The fiber to metal coefficient of friction ($\mu_{FM}$) was determined at 68° F. and 40% relative humidity with a pretension of 20 grams, contact angle ($\theta$) of 180°, and yarn speed of 100 m/min. The fiber to fiber coefficient of friction ($\mu_{FF}$) was determined at 68° F. and 40% relative humidity with a pretension of 20 grams, contact angle ($\theta$) of 1080°, and yarn speed of 1.0 m/min. Coefficients of friction were calculated using the Capstan equation:

$$\mu = \frac{\text{Log(Outgoing Tension } (T_2)/\text{Incoming Tension } (T_1))}{(0.434)\ (\theta \text{ in Radians})}$$

Stick-slip is the differential between the maximum and minimum outgoing tension ($T_2$) values. Eight-second voltage decay provides a measure of the resistance of the treated yarn to static charge buildup. A Rothschild F-Meter was employed in conjunction with a Rothschild Static Volt-Meter to determine the amount of charge (in volts) developed in an eight-second interval as a single strand of the yarn was moved over a metal pin at a constant rate (100 m/min.). All of the reported values are the average of at least three determinations.

| FIBER FINISH NO. | $\mu_{FM}$ | 8-SEC. VOLTAGE | $\mu_{FF}$ | STICK-SLIP (GMS) |
|---|---|---|---|---|
| I | 0.63 | 0 | 0.038 | 19 |
| II | 0.65 | 0 | 0.037 | 17 |
| III | 0.67 | 0 | 0.036 | 14 |
| IV | 0.62 | 0 | 0.035 | 19 |
| V | 0.61 | 0 | 0.035 | 18 |
| VI | 0.62 | 0 | 0.035 | 15 |
| VII | 0.59 | 0 | 0.035 | 19 |
| VIII | 0.60 | 0 | 0.037 | 21 |
| IX | 0.64 | 0 | 0.038 | 27 |

-continued

| FIBER FINISH NO. | $\mu_{FM}$ | 8-SEC. VOLTAGE | $\mu_{FF}$ | STICK-SLIP (GMS) |
|---|---|---|---|---|
| X | 0.65 | 0 | 0.040 | 24 |
| XI | 0.64 | 0 | 0.039 | 23 |
| XII | 0.65 | 0 | 0.040 | 25 |
| XIII | 0.55 | 0 | 0.034 | 21 |
| XIV | 0.54 | 0 | 0.031 | 21 |
| XV | 0.54 | 90 | 0.035 | 21 |

We claim:

1. An aqueous composition useful as a fiber finish for polypropylene fibers, filaments and yarns, said aqueous composition being essentially a clear liquid homogeneous solution having a 25° C. knematic viscosity from about 100 to 200 centistokes, consisting essentially of:

(a) 30 to 90 weight percent α-alkyl-Ω-hydroxypoly (oxyethyl-ene) produced by condensation of 1 mole of $C_{11-15}$ straight-chain randomly substituted secondary alcohols with an average of 7 to 20 moles of ethylene oxide;

(b) 5 to 60 weight percent ethoxylated alcohol phosphate ester selected from the group consisting of α-dodecyl-Ω-hydroxypoly(oxyethyl-ene) mixture of dihydrogen phosphate and monohydrogen phosphate esters that have an acid number to pH 5.2 of 103–111 and that are produced by the esterification of the condensation product of 1 mole of n-dodecyl alcohol with 4–4.5 moles of ethylene oxide and α-tridecyl-Ω-hydroxypoly(oxyethyl-ene) mixture of dihydrogen phosphate and monohydrogen phosphate esters that have an acid number to pH 5.2 of 75–85 and that are produced by the esterification of the condensation product of one mole of "oxo" process tridecyl alcohol with 5.5–6.5 moles of ethylene oxide, and neutralized with essentially a stoichiometric amount of potassium hydroxide; and (c) 0.5 to 25 weight percent water.

2. The aqueous composition of claim 1 containing an effective amount, up to 20 weight percent, of a hydroxylic coupling agent selected from the group consisting of ethyl alcohol, propylene glycol, glycerine and sorbitol.

3. The aqueous composition of claim 2 comprised of 35 to 70 weight percent (a), 5 to 35 weight percent (b), 1 to 20 weight percent water, and 5 to 15 weight percent hydroxylic coupling agent.

4. The aqueous composition of claim 3 wherein the hydroxylic coupling agent is propylene glycol.

5. The aqueous composition of claim 4 wherein (a) is α-alkyl-Ω-hydroxypoly(oxyethyl-ene) produced by the condensation product of 1 mole of $C_{11-15}$ straight-chain randomly substituted secondary alcohols with an average of 7 moles of ethylene oxide.

6. The aqueous composition of claim 4 wherein (a) is α-alkyl-Ω-hydroxypoly(oxyethyl-ene) produced by the condensation of 1 mole of $C_{11-15}$ straight-chain randomly substituted secondary alcohols with an average of 9 moles of ethylene oxide.

7. The aqueous composition of claim 4 wherein (a) is α-alkyl-Ω-hydroxypoly(oxyethyl-ene) produced by the condensation of 1 mole of $C_{11-15}$ straight-chain randomly substituted secondary alcohols with an average of 12 moles of ethylene oxide.

* * * * *